US011692432B2

(12) United States Patent
Phillips et al.

(10) Patent No.: US 11,692,432 B2
(45) Date of Patent: Jul. 4, 2023

(54) REAL TIME SURVEYING WHILE DRILLING

(71) Applicant: Schlumberger Technology Corporation, Sugar Land, TX (US)

(72) Inventors: Wayne J. Phillips, Houston, TX (US); Konstantin Bulychenkov, Katy, TX (US); Ross Lowdon, Katy, TX (US); Michael Edmunds, Stonehouse (GB); Zainab Orooq, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 372 days.

(21) Appl. No.: 16/973,696

(22) PCT Filed: Jun. 3, 2019

(86) PCT No.: PCT/US2019/035149

§ 371 (c)(1),
(2) Date: Dec. 9, 2020

(87) PCT Pub. No.: WO2019/240971

PCT Pub. Date: Dec. 19, 2019

(65) Prior Publication Data

US 2021/0254448 A1 Aug. 19, 2021

Related U.S. Application Data

(60) Provisional application No. 62/823,112, filed on Mar. 25, 2019, provisional application No. 62/683,134, filed on Jun. 11, 2018.

(51) Int. Cl.
*E21B 47/022* (2012.01)
*E21B 47/07* (2012.01)
(Continued)

(52) U.S. Cl.
CPC ..... *E21B 47/022* (2013.01); *E21B 7/06* (2013.01); *E21B 44/02* (2013.01); *E21B 47/07* (2020.05)

(58) Field of Classification Search
CPC ..... E21B 47/022; E21B 47/07; E21B 7/06; E21B 44/02
See application file for complete search history.

(56) References Cited

U.S. PATENT DOCUMENTS 4,813,274 A 3/1989 Dipersio et al.
7,114,565 B2 10/2006 Estes et al.
(Continued)

FOREIGN PATENT DOCUMENTS

EP 3312382 A1 4/2018
WO 2009064728 A1 5/2009
(Continued)

OTHER PUBLICATIONS

International Search Report and Written Opinion issued in International Patent Application No. PCT/US2019/035149, dated Sep. 24, 2019, 14 pages.
(Continued)

*Primary Examiner* — Dany E Akakpo

(57) ABSTRACT

A method for drilling a subterranean wellbore includes rotating a drill string in the subterranean wellbore. The drill string includes a drill collar, a drill bit, and survey sensors (e.g., a triaxial accelerometer set and a triaxial magnetometer set) deployed therein. The triaxial accelerometer set and the triaxial magnetometer set make corresponding accelerometer and magnetometer measurements while drilling (rotating). These measurements are synchronized to obtain synchronized accelerometer and magnetometer measurements and then further processed to compute at least an inclination and an azimuth of the subterranean wellbore while drilling. The method may further optionally include
(Continued)

changing a direction of drilling the subterranean wellbore in response to the computed inclination and azimuth.

25 Claims, 6 Drawing Sheets

(51) Int. Cl.
*E21B 7/06* (2006.01)
*E21B 44/02* (2006.01)

(56) References Cited

U.S. PATENT DOCUMENTS

| | | | | |
|---|---|---|---|---|
| 7,650,269 | B2 | 1/2010 | Rodney | |
| 7,886,844 | B2 | 2/2011 | Phillips | |
| 11,578,586 | B2 | 2/2023 | Sobhana | |
| 2013/0151157 | A1 | 6/2013 | Brooks et al. | |
| 2013/0282290 | A1 | 10/2013 | Weston et al. | |
| 2015/0362617 | A1 | 12/2015 | Munoz et al. | |
| 2016/0041293 | A1 | 2/2016 | Boudah et al. | |
| 2019/0353023 | A1 * | 11/2019 | Whitacre | E21B 7/06 |

FOREIGN PATENT DOCUMENTS

| | | | |
|---|---|---|---|
| WO | 2014165389 | A1 | 10/2014 |
| WO | WO-2016200766 | A1 * | 12/2016 |

OTHER PUBLICATIONS

Extended European Search Report in European Patent Application No. 19818595.1, dated Jan. 21, 2022, 4 pages.

* cited by examiner

REAL TIME SURVEYING WHILE DRILLING

CROSS REFERENCE TO RELATED APPLICATIONS

This application claims the benefit of and priority to U.S. Provisional Application No. 62/683,134, filed on Jun. 11, 2018, and U.S. Provisional Application No. 62/823,112, filed on Mar. 25, 2019, the entirety of both of which are incorporated herein by reference.

BACKGROUND

In conventional drilling and measurement while drilling (MWD) operations, wellbore inclination and wellbore azimuth are determined at a discrete number of longitudinal points along the axis of the wellbore. These discrete measurements may be assembled into a survey of the well and used to calculate a three-dimensional well path (e.g., using the minimum curvature or other curvature assumptions). Wellbore inclination is commonly derived (computed) from tri-axial accelerometer measurements of the earth's gravitational field. Wellbore azimuth (also commonly referred to as magnetic azimuth) is commonly derived from a combination of tri-axial accelerometer and tri-axial magnetometer measurements of the earth's gravitational and magnetic fields.

Static surveying measurements are made after drilling has temporarily stopped (e.g., when a new length of drill pipe is added to the drill string) and the drill bit is lifted off bottom. Such static measurements are commonly made at measured depth intervals ranging from about 30 to about 90 feet. While these static surveying measurements may, in certain operations, be sufficient to obtain a well path of suitable accuracy, such static surveying measurements are time consuming as they require drilling to temporarily stop and the drill string to be lifted off the bottom of the wellbore.

SUMMARY

A method for drilling a subterranean wellbore is disclosed. In some embodiments, the method includes rotating a drill string in the subterranean wellbore to drill the wellbore. The drill string includes a drill collar, a drill bit, and survey sensors (e.g., a triaxial accelerometer set and a triaxial magnetometer set) deployed therein. The triaxial accelerometer set and the triaxial magnetometer set make corresponding accelerometer and magnetometer measurements while drilling (rotating). These measurements are synchronized to obtain synchronized accelerometer and magnetometer measurements and then further processed to compute at least an inclination and an azimuth of the subterranean wellbore while drilling. The method may further include changing a direction of drilling the subterranean wellbore in response to the computed inclination and azimuth. In some embodiments the synchronizing includes removing a first time lag and a second time lag from the magnetometer measurements and removing a third time lag from the accelerometer measurements.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

A method for drilling a subterranean wellbore is disclosed. In some embodiments, the method includes rotating a drill string in the subterranean wellbore to drill the wellbore. The drill string includes a drill collar, a drill bit, and survey sensors (e.g., a triaxial accelerometer set and a triaxial magnetometer set) deployed therein. The triaxial accelerometer set and the triaxial magnetometer set make corresponding accelerometer and magnetometer measurements while drilling (rotating). These measurements are synchronized to obtain synchronized accelerometer and magnetometer measurements and then further processed to compute at least an inclination and an azimuth of the subterranean wellbore while drilling.

The disclosed embodiments may provide various technical advantages and improvements over the prior art. For example, in some embodiments, the disclosed embodiments provide an improved method and system for drilling a subterranean wellbore in which desired survey parameters such as wellbore inclination and wellbore azimuth (and optionally further including dip angle and magnetic toolface) are computed in real time while drilling the well (e.g., several measurements per minute or several measurements per foot of measured depth of the wellbore). The disclosed embodiments may therefore provide a much higher density of survey measurements along the wellbore profile than are available via conventional static surveying methods. This higher measurement density may then enable a more accurate wellbore path to be determined. Improving the timeliness and density of wellbore surveys may further advantageously improve the speed and effectiveness of wellbore steering activities, such as anti-collision decision making.

Moreover, the disclosed methods synchronize magnetometer measurements and accelerometer measurements and thereby advantageously improve the accuracy of the computed survey parameters as compared to prior art dynamic surveying methods. In some embodiments, the accuracy of the computed survey parameters may be sufficiently high that there is no longer a need to make conventional static surveying measurements (or such that the number of required static surveys may be reduced). This can greatly simplify wellbore drilling operations and significantly reduce the time and expense required to drill the well. Moreover, eliminating or reducing the number of required static surveys may improve steerability, for example, via reducing wellbore washout in soft formations. Such washout can be caused by drilling fluid circulation when the drill string is stationary and is known to cause subsequent steering problems.

Figure 1:
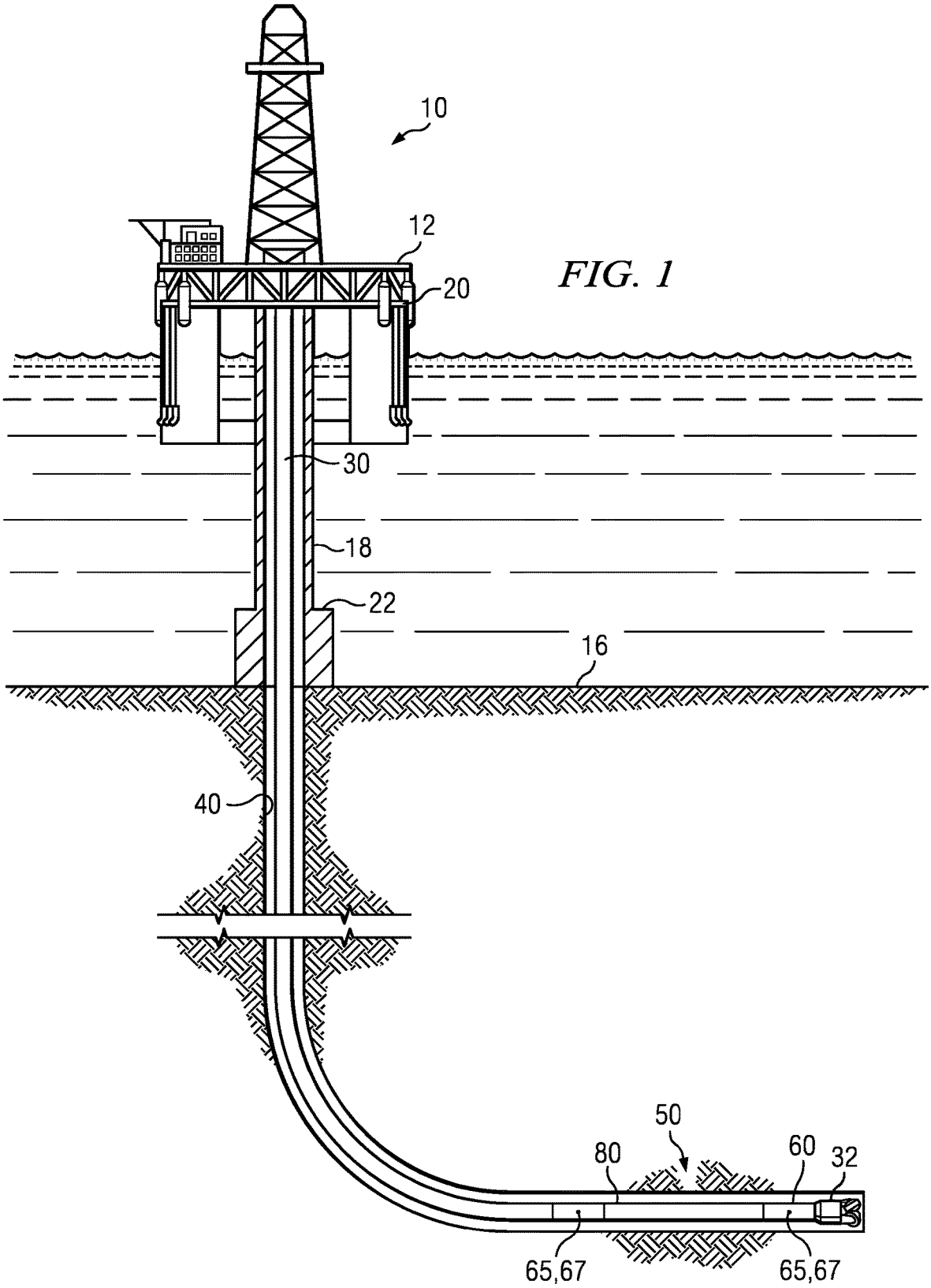
FIG. 1 depicts an example drilling rig on which disclosed embodiments may be utilized.

FIG. 1 depicts a drilling rig 10 suitable for using various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a rotary steerable tool 60. Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
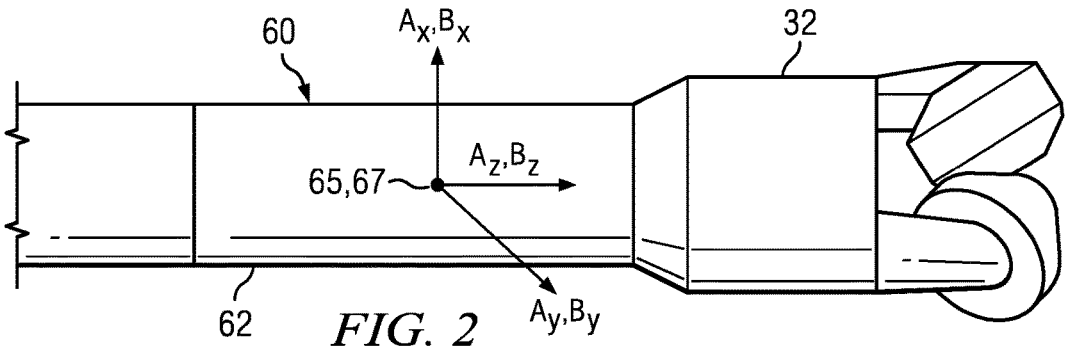
FIG. 2 depicts a lower BHA portion of the drill string shown on FIG. 1.

FIG. 2 depicts the lower BHA portion of drill string 30 including drill bit 32 and rotary steerable tool 60. In the depicted embodiment, rotary steerable tool body 62 is connected with the drill bit 32 and may be (or may not be) configured to rotate with the drill bit 32. Rotary steerable tools 60 include steering elements that may be actuated to control and/or change the direction of drilling the wellbore 40. In embodiments employing a rotary steerable tool, substantially any suitable rotary steerable tool configuration may be used. Various rotary steerable tool configurations are known in the art. For example, the AutoTrak® rotary steerable system (available from Baker Hughes), and the GeoPilot rotary steerable system (available from Sperry Drilling Services) include a substantially non-rotating (or slowly rotating) outer housing employing blades that engage the wellbore wall. Engagement of the blades with the wellbore wall is intended to eccenter the tool body, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the wellbore wall.

The PowerDrive rotary steerable systems (available from Schlumberger) fully rotate with the drill string (i.e., the outer housing rotates with the drill string). The PowerDrive Xceed makes use of an internal steering mechanism that does not require contact with the wellbore wall and enables the tool body to fully rotate with the drill string. The PowerDrive X5, X6, and Orbit rotary steerable systems make use of mud actuated blades (or pads) that contact the wellbore wall. The extension of the blades (or pads) is rapidly and continually adjusted as the system rotates in the wellbore. The PowerDrive Archer® makes use of a lower steering section joined at a swivel with an upper section. The swivel is actively tilted via pistons so as to change the angle of the lower section with respect to the upper section and maintain a desired drilling direction as the bottom hole assembly rotates in the wellbore. Accelerometer and magnetometer sets may rotate with the drill string or may alternatively be deployed in an internal roll-stabilized housing such that they remain substantially stationary (in a bias phase) or rotate slowly with respect to the wellbore (in a neutral phase). To drill a desired curvature, the bias phase and neutral phase are alternated during drilling at a predetermined ratio (referred to as the steering ratio).

While FIG. 2 depicts a rotary steerable tool 60, it will be understood the disclosed embodiments are not limited to the use of a rotary steerable tool. Moreover, while the accelerometer and magnetometer sensor sets 65 and 67 may be deployed and processed in a rotary steerable tool (as depicted on FIG. 2), they may also be located elsewhere within the drill string. With reference again to FIG. 1, drill string 30 may further include a measurement while drilling tool 80 including corresponding accelerometer and magnetometer sensor sets 65 and 67. As depicted, the MWD tool 80 is commonly deployed further uphole in the drill string (i.e., above the rotary steerable tool 60). As is known to those of ordinary skill in the art, such MWD tools 80 may rotate with the drill string and may further include a mud pulse telemetry transmitter or other telemetry system, an alternator for generating electrical power, and an electronic controller. It will thus be appreciated that the disclosed embodiments are not limited to any specific deployment location of the accelerometer and magnetometer sensor sets 65 and 67 in the drill string.

With continued reference to FIGS. 1 and 2, the depicted rotary steerable tool 60 and/or MWD tool include(s) tri-axial accelerometer 65 and tri-axial magnetometer 67 navigation sensor sets, which could be any suitable commercially available devices. Suitable accelerometers for use in sensor set 65 may be chosen from among substantially any suitable commercially available devices known in the art. Suitable accelerometers may alternatively include micro-electro-mechanical systems (MEMS) solid-state accelerometers, which tend to be shock resistant, high-temperature rated, and inexpensive. Suitable magnetic field sensors for use in sensor set 67 may include conventional ring core flux gate magnetometers or conventional magnetoresistive sensors.

FIG. 2 further includes a diagrammatic representation of the tri-axial accelerometer and magnetometer sensor sets 65 and 67. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the tool axis (and therefore the wellbore axis) as indicated (although disclosed embodiments are not limited by such conventions). Each of the accelerometer and magnetometer sets may therefore be considered as determining a plane (the x and y-axes) and a pole (the z-axis along the axis of the BHA).

By convention, the gravitational field is taken to be positive pointing downward (i.e., toward the center of the earth) while the magnetic field is taken to be positive pointing towards magnetic north. Moreover, also by convention, the y-axis is taken to be the toolface reference axis (i.e., gravity toolface GTF equals zero when the y-axis is uppermost and magnetic toolface MTF equals zero when the y-axis is pointing towards the projection of magnetic north in the xy plane). The magnetic toolface MTF is projected in the xy plane and may be represented mathematically as: $\tan(MTF)=B_x/B_y$. Likewise, the gravity toolface GTF may be represented mathematically as: $\tan(GTF)=(A_x)/(A_y)$. The negative signs in the gravity toolface expression arise owing to the convention that the gravity vector is positive in the downward direction while the toolface angle GTF is positive on the high side of the wellbore (the side facing upward).

The disclosed method embodiments are not limited to the above described conventions for defining wellbore coordinates. These conventions can affect the form of certain of the mathematical equations that follow in this disclosure. Those of ordinary skill in the art will be readily able to utilize other conventions and derive equivalent mathematical equations.

The accelerometer and magnetometer sets 65, 67 may be configured for making downhole navigational (surveying) measurements during a drilling operation. Such measurements are well known and commonly used to determine, for example, wellbore inclination, wellbore azimuth, gravity toolface, magnetic toolface, and dipping angle (dip). The accelerometers and magnetometers may be electrically coupled to a digital signal processor (or other digital controller) through corresponding signal analog signal conditioning circuits as described in more detail below. The signal conditioning circuits may include low-pass filter elements that are intended to band-limit sensor noise and therefore tend to improve sensor resolution and surveying accuracy.

Figure 3:
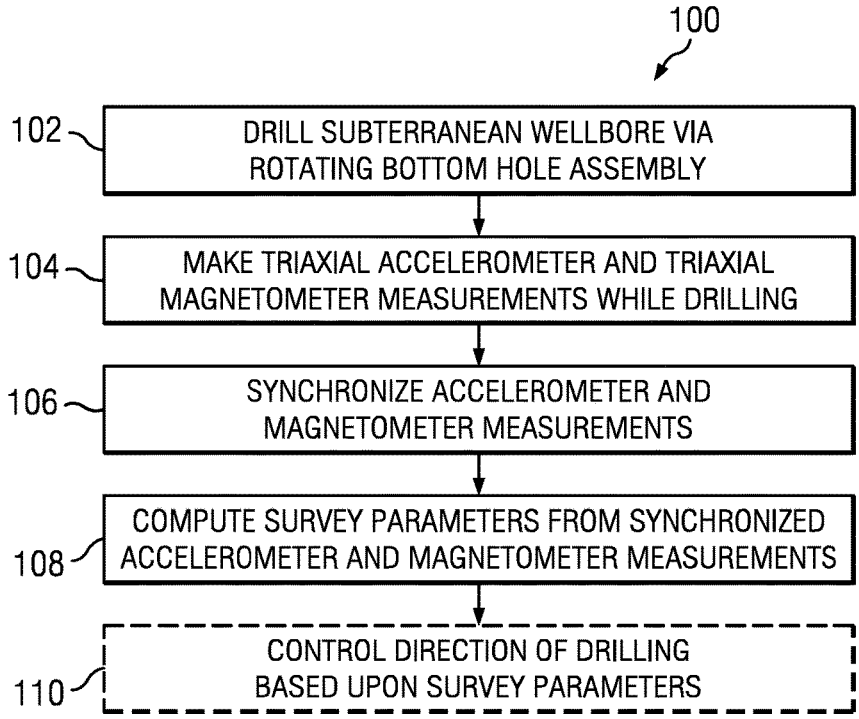
FIG. 3 depicts a flow chart of one example method for drilling a subterranean wellbore.

FIG. 3 depicts a flow chart of one example method embodiment 100 for drilling a subterranean wellbore. A bottom hole assembly (e.g., as depicted on FIGS. 1 and 2) is rotated in the wellbore at 102 to drill the well. Triaxial accelerometer and triaxial magnetometer measurements are made at 104 while drilling in 102 (i.e., while rotating the bottom hole assembly in the wellbore to drill the well). The accelerometer measurements and magnetometer measurements are synchronized at 106 to obtain corrected/synchronized measurements. As described in more detail below, the accelerometer and magnetometer measurements may be synchronized by compensating for temperature drift, phase shift and attenuation of the measurements, and/or distortion caused by magnetic interference. The corrected/synchronized measurements may then be processed at 108 to compute the desired wellbore survey parameters, for example, one or more of wellbore inclination, wellbore azimuth, and dip angle. The wellbore survey parameters may then optionally be used for wellbore position and trajectory control at 110 while drilling in 102. For example, the direction of drilling in 102 may be adjusted in response to the survey parameters (e.g., by adjusting the position of blades or other actuating components in a rotary steerable tool) to continue drilling along a predetermined path.

One aspect of the disclosed embodiments is the discovery that there can be a phase difference (a delay) and an attenuation difference between the accelerometer and magnetometer data streams. These phase and attenuation differences may be caused, for example, by the corresponding circuits used to receive the analog data streams from the accelerometer and magnetometer sets. As described in more detail below, each of the circuits tends to attenuate and delay the received data stream. Moreover, since the properties of analog circuit components tend to vary with temperature, the attenuation and phase delay can vary (e.g., can significantly vary) with downhole temperature. The attenuation and delay can be further influenced by radial magnetic interference, such as fields induced in the drill collar, by the Earth's magnetic field, or from electrical currents in a nearby power bus. If unaccounted, these phase and attenuation differences can result in significant errors in computed survey parameters, particularly in wellbore azimuth and dip angle which are computed using a combination of accelerometer and magnetometer measurements.

Figure 4:
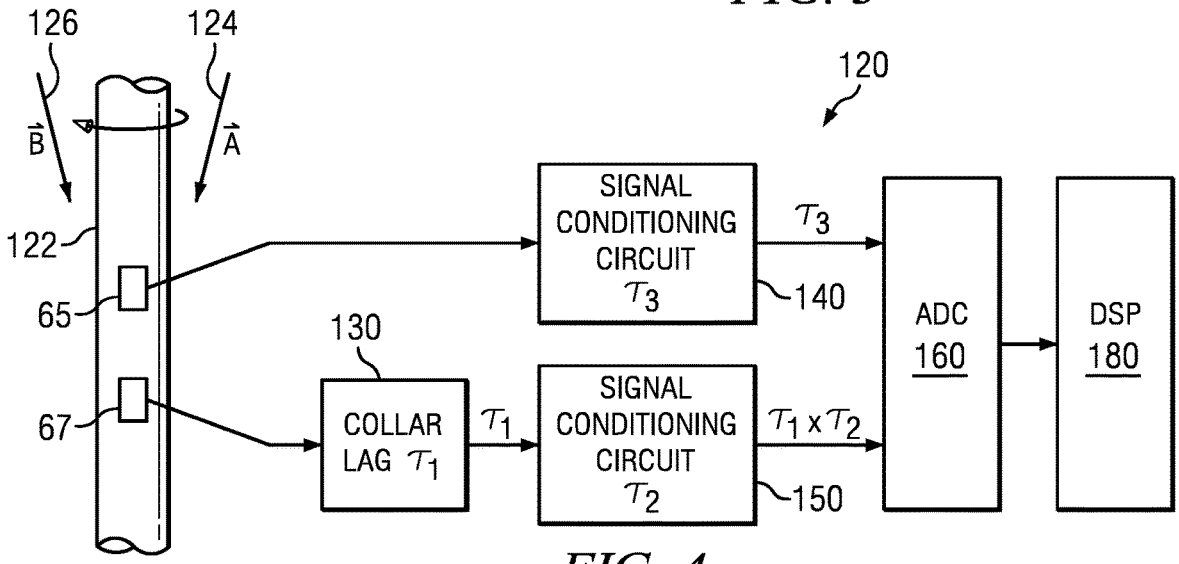
FIG. 4 depicts a schematic diagram of an embodiment of a system suitable for executing the method embodiment depicted on FIG. 3.

FIG. 4 depicts a schematic diagram of an embodiment of a system 120 suitable for executing method 100. The system 120 includes a drill collar 122 (such as drill string 30 including rotary steerable tool 60 and/or MWD tool 80) rotating in a subterranean wellbore (e.g., rotating while rotary drilling the wellbore). As described above with respect to FIG. 1, the drill collar 122 includes triaxial accelerometer and triaxial magnetometer sets 65, 67 deployed therein and configured to measure the Earth's gravitational and magnetic fields while rotating. The gravitational and magnetic fields of the Earth are depicted at 124 and 126 as A and $\overline{B}$. Owing to the rotation of the drill collar 122, each of the accelerometers in the triaxial accelerometer set 65 measures a corresponding time varying gravitational field, $A_x(t)$, $A_y(t)$, $A_z(t)$. Likewise, each of the magnetometers in the triaxial magnetometer set 67 measures a corresponding time varying magnetic field, $B_x(t)$, $B_y(t)$, $B_z(t)$. These time varying gravitational field and magnetic field measurements are received (and filtered) by corresponding signal conditioning circuits 140 and 150. The time varying measurements are then digitized at some predetermined frequency (e.g., in a range from about 100 to about 1000 Hz) via an analog to digital converter 160. The digitized measurements $A_x$, $A_y$, $A_z$ and $B_x$, $B_y$, $B_z$ are then received by a digital signal processor 180 where they are processed to compute the various survey parameters (e.g., including wellbore inclination, wellbore azimuth, gravity toolface, magnetic toolface, and dip) in real-time while drilling. By real-time it is meant that the survey parameters are computed while rotating the drill string to drill the wellbore (as opposed to conventional static measurements which are made while drilling has stopped). The real-time survey measurements may be computed at substantially any frequency, for example, in a range from about 0.1 to about 100 Hz depending on how much averaging is employed. Such a measurement frequency corresponds to a measured depth interval ranging from a fraction of an inch to a few inches (as compared to 30 or 90 feet for conventional static measurements).

One aspect of the disclosed embodiments is the discovery that rotation of the drill collar 122 in the Earth's magnetic field (or in the presence of other magnetic interference) may create an additional magnetic field in the collar bore. This additional field can cause the time varying magnetic field measured by the individual magnetometers in the magnetometer set 67 to lag behind the Earth's magnetic field. Such drill collar lag is depicted at 130 and represented by $\tau_1$. The time varying gravitational and magnetic field measurements are received by corresponding accelerometer and magnetometer electrical signal conditioning circuits 140 and 150 prior to digitizing the signals via ADC 160. As depicted, the accelerometer circuit 140 induces a corresponding time lag and attenuation $\tau_3$ in the accelerometer measurements while the magnetometer circuit 150 induces a corresponding time lag and attenuation $\tau_2$ in the magnetometer measurements. In general the product (or convolution) of lags $\tau_1$ and $\tau_2$ is not equal to lag $\tau_3$ such that the time varying gravitational and magnetic field measurements are generally out of phase (i.e., not synchronized). This can induce errors in the computed survey parameters, particularly in the computed wellbore azimuth and dip since these parameters are computed using both accelerometer and magnetometer measurements.

Figure 5:
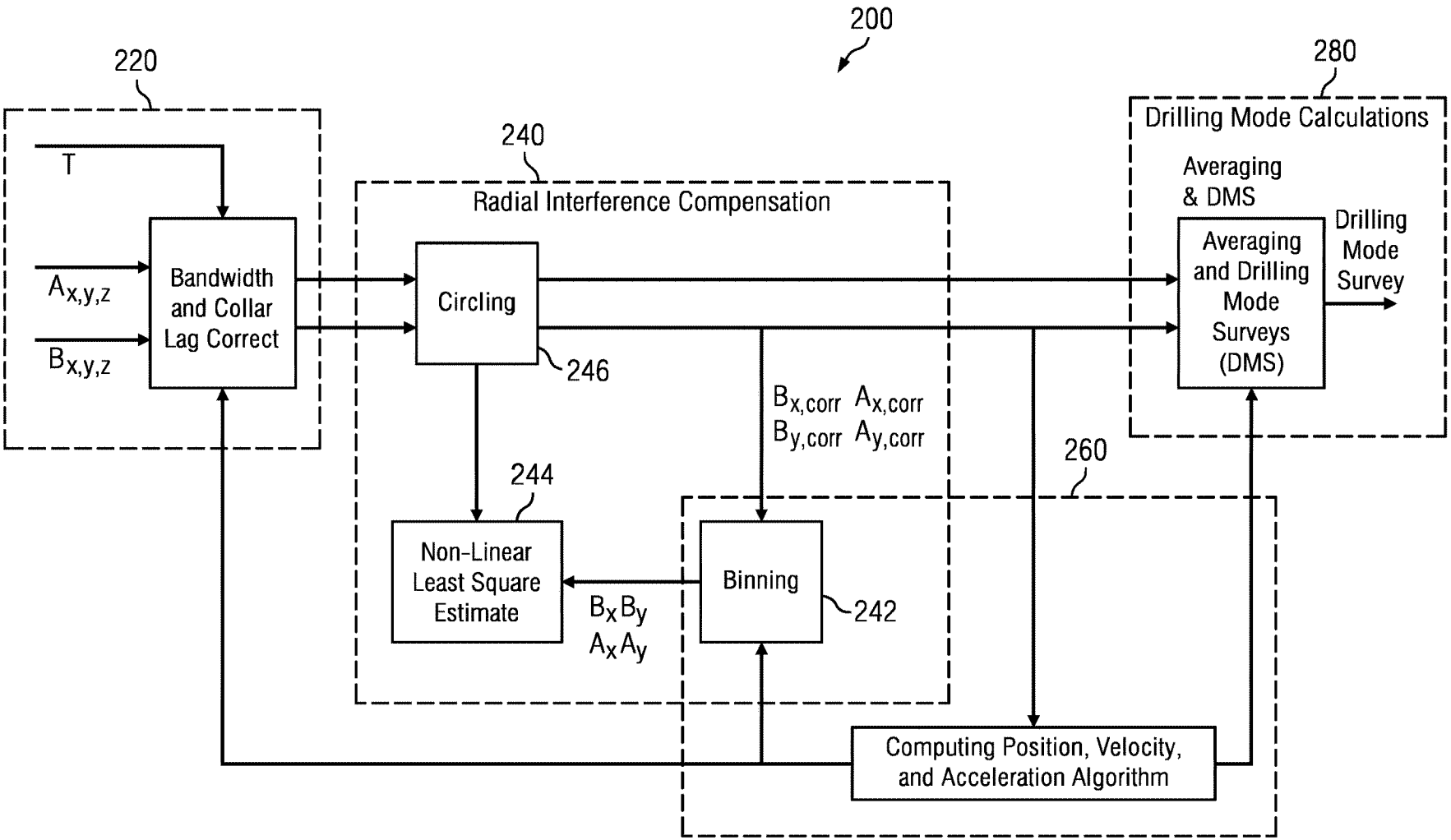
FIG. 5 depicts a block diagram of an example method embodiment for computing survey parameters, such as wellbore inclination, wellbore azimuth, and dip, while drilling a subterranean wellbore.

FIG. 5 depicts a block diagram of an example method 200 for computing survey parameters in real time while drilling a subterranean wellbore. The method may be executed, for example, using a digital signal processor located in the bottom hole assembly (e.g., DSP 180 shown on FIG. 4). As depicted, the method 200 includes four blocks: (i) a bandwidth compensation block 220, (ii) a radial interference compensation block 240, (iii) a dynamics block 260 in which the position, velocity, and acceleration of the drill collar are computed, and (iv) a drilling mode survey block 280 in which the survey parameters are computed. In the example embodiment depicted on FIG. 5, the digitized accelerometer and magnetometer measurements are first processed by bandwidth compensation block 220 and then by radial interference compensation block 240 (with block 240 receiving the output from block 220 as input). It will be appreciated that such depiction is for convenience only as the processing in block 240 may alternatively precede the processing in block 220 (such that the output from block 240 is received as input in block 220). The disclosed embodiments are not limited in this regard.

With continued reference to FIG. 5, digitized accelerometer and magnetometer measurements $A_x$, $A_y$, $A_z$ and $B_x$, $B_y$, $B_z$ along with corresponding temperature measurements T are processed in the bandwidth correction block 220 to compensate (correct) attenuation and delay of the front end analog measurements (the time varying gravitational field and magnetic field measurements described above with respect to FIG. 4) introduced by signal conditioning circuits 140 and 150. Such compensation may be understood to synchronize the accelerometer and magnetometer measurements. The bandwidth correction block 220 may optionally be configured to correct for temperature variation in the time constants of the signal conditioning circuits 140 and 150 (which induce lags $\tau_3$ and $\tau_2$). In various additional embodiments, the bandwidth correction block 220 may further apply a collar lag compensation to correct for the effect of lag $\tau_1$ on the magnetometer measurements.

Figure 6:
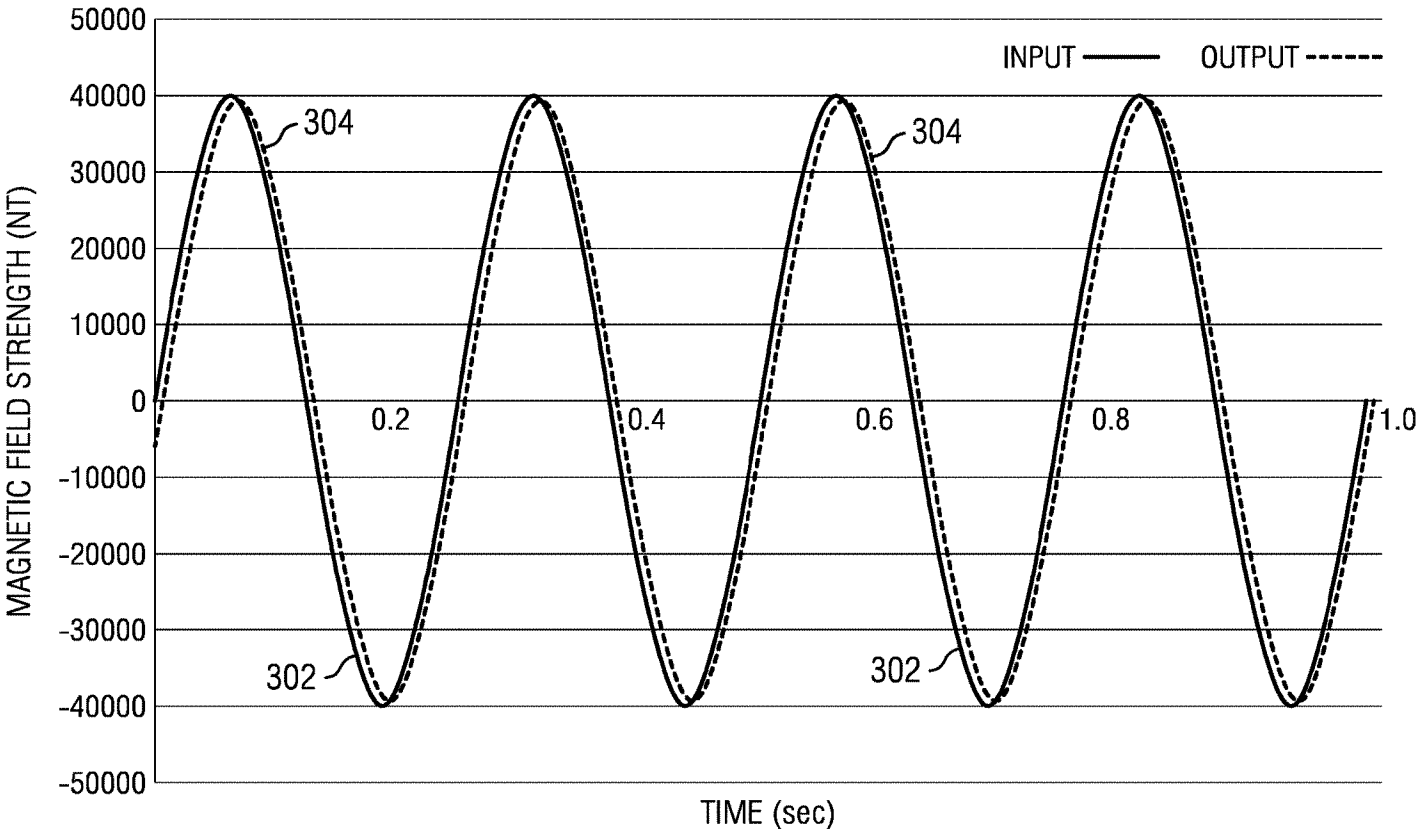
FIG. 6 depicts a plot of magnetic field strength versus time for a magnetometer rotating at 240 rpm.

FIG. 6 depicts a plot of magnetic field strength versus time for a magnetometer rotating at 240 rpm. The input magnetic field is depicted at 302 while the magnetometer output is depicted at 304. Note that in the depicted example, the magnetometer output is attenuated by about 1-5%, e.g., 2% or 4%, and undergoes a phase delay of about 5-15 degrees, e.g., 7 degrees, 10 degrees, or 13 degrees. While not depicted, it will be appreciated that the accelerometer output may also be attenuated and phased delayed (although generally to a different degree than that of the magnetometer output). The attenuation and phase delay may vary depending on the circuits used, the temperature, and a variety of other factors.

In the frequency range of interest (e.g., from about 5 to about 500 rpm), the signal conditioning circuits 140 and 150 may be modelled as low pass filters having corresponding time constants. For example, each of the conditioning circuits may be modelled (e.g., approximated) as an RC filter circuit such as depicted on FIG. 7 in which $S_{uf}$ represents the unfiltered sensor signal and $S_f$ represents the filtered sensor signal. In other words, with respect to signal conditioning circuit 140, $S_{uf}$ represents the input accelerometer signal (the accelerometer signal received by the circuit 140) and $S_f$ represents the output accelerometer signal. For signal conditioning circuit 150, $S_{uf}$ represents the input magnetometer signal (the magnetometer signal received by the circuit 150) and $S_f$ represents the output magnetometer signal.

Figure 7:
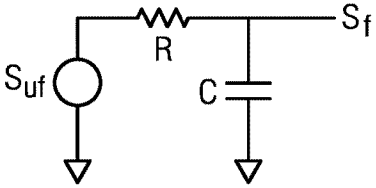
FIG. 7 depicts an example RC filter circuit.

With continued reference to FIG. 7, the unfiltered sensor signal $S_{uf}$ and the filtered sensor signal $S_f$ may be related mathematically, for example, as follows:

$$S_{uf}=\tau S_f+S_f \tag{1}$$

where $\tau$ represents the time constant of the circuit and $S_f$ represents the first derivative of the filtered sensor signal with respect to time. The symbol $\tau$ is used herein to represent both a time constant (as in Equation 1) and the corresponding time lag and attenuation induced by the time constant (e.g., as in FIG. 4). Those of ordinary skill in the art will readily recognize that a time constant of a circuit such as signal conditioning circuits 140 and 150 may be thought of as inducing a corresponding time lag and attenuation in a signal and that the induced lag and attenuation is a function of the signal frequency.

The instantaneous unfiltered sensor signal $S(i)_{uf}$ (the signal at any instant in time) may be computed mathematically from the instantaneous filtered sensor signal $S(i)_f$, for example, as follows $$S(i)_{uf} = S(i)_f + S_\perp\cos\psi(\tau^2\psi^2 \quad 3\tau^3\psi\psi + 3\tau^3\psi^2 \quad \tau^4\psi^4\ ) + S_\perp\sin\psi\,(\tau\psi + \tau^2\psi + \tau^3\psi^3 \quad 6\tau^4\psi^2\psi\ ) \tag{2}$$

where $S_\perp$ represents the transverse component of the measured gravitational field or the magnetic field (e.g., such that $A_\perp=\sqrt{A_x^2+A_y^2}$ and $B_\perp=\sqrt{B_x^2+B_y^2}$), $\psi$ represents the rotational position of the drill collar, $\psi$ represents the rotational velocity of the rotating drill collar, and $\psi$ represents the rotational acceleration of the rotating drill collar. For example, may be related to the magnetic or gravity toolface, while $\psi$ and $\psi$ may related to the first and second derivatives of the toolface. Note that $\psi$, $\psi$, and $\psi$ may be computed in and received from dynamics block 260 as described in more detail below.

With reference again to FIG. 5, bandwidth correction block 220 may compensate for the attenuation and phase delay in the accelerometer and magnetometer measurements (e.g., synchronize the measurements) via processing the digitized measurements according to Equation 2. For example, compensated x-, y-, and/or z-axis accelerometer measurements may be computed from the corresponding uncompensated measurements as follows:

$$A_c = A_{uc} + A_\perp\cos\psi(\tau_3^2\psi^2 \quad 3\tau_3^3\psi\psi + 3\tau_3^3\psi^2 \quad \tau_3^4\psi^4\ ) + A_\perp\sin\psi\,(\tau_3\psi + \tau_3^2\psi + \tau_3^3\psi^3 \quad 6\tau_3^4\psi^2\psi\ ) \tag{3}$$

where $A_c$ represent the compensated accelerometer measurement, $A_{uc}$ represent the uncompensated accelerometer measurement (e.g., $A_x$, $A_y$, and/or $A_z$ as measured) and $A_\perp$ represents the transverse component of the gravity field. In Equation 3, $\tau_3$ represents the time constant of the accelerometer conditioning circuit 140. Moreover, $\psi$, $\psi$, and $\psi$ represent the rotational position, the rotational velocity, and the rotational acceleration of the drill collar (or the accelerometers in the tool collar) and may be determined, for example, as described below with respect to block 260. In some embodiments, each of the triaxial accelerometer measurements ($A_x$, $A_y$, and $A_z$) may be compensated according to Equation 3. In some embodiments only the cross-axial (transverse) measurements ($A_x$ and $A_y$) are compensated.

Likewise, compensated magnetometer measurements may be computed from the uncompensated measurements as follows:

$$B_c = B_{uc} + B_{\perp}\cos\psi(\tau_2^2\psi^2 \quad 3\tau_2^3\psi\psi + 3\tau_2^3\psi^2 \quad \tau_2^4\psi^4) + B_{\perp}\sin\psi(\tau_2\psi + \tau_2^2\psi + \tau_2^3\psi^3 \quad 6\tau_2^4\psi^2\psi) \tag{4}$$

where $B_c$ represent the compensated magnetometer measurements, $B_{uc}$ represent the uncompensated magnetometer measurements, and $B_{\perp}$ represents the transverse component of the magnetic field. In Equation 4, $\tau_2$ represents the time constant of the magnetometer conditioning circuit 150. Moreover, $\psi$, $\psi$, and $\psi$ represent rotational position, the rotational velocity, and the rotational acceleration of the drill collar (or the magnetometers in the tool collar) and may be determined, for example, as described in more detail below. In some embodiments, each of the triaxial magnetometer measurements ($B_r$, $B_y$, and $B_z$) may be compensated according to Equation 3. In some embodiments only the cross-axial (transverse) measurements ($B_x$ and $B_y$) are compensated.

With continued reference to FIG. 5, bandwidth correction block 220 may further correct for the temperature variation in time constants $\tau_3$ and $\tau_2$ of the signal conditioning circuits 140 and 150. For example, in Equations 3 and 4, $\tau_3$ and $\tau_2$ may be expressed as corresponding functions of the measured downhole temperature T such that $\tau_3=f_3$ (T) and $\tau_2=f_2$ (T). The time constants $\tau_3$ and $\tau_2$ for each of the signal conditioning circuits 140 and 150 may be measured at various temperatures (e.g., ranging from 25 to 175 degrees C.). These temperature dependent time constant measurements may then be fit to corresponding functions $f_3$ and $f_2$ (such as to polynomial functions) or stored in corresponding lookup tables. Block 220 may be configured to process the downhole temperature measurements T to compute corresponding values of $\tau_3$ and $\tau_2$ according to $f_3$ and $f_2$ (or to obtain the values from corresponding lookup tables). These temperature dependent values of $\tau_3$ and $\tau_2$ may then be used in Equations 3 and 4 to compute the corresponding compensated measurements.

With still further reference to FIG. 5, bandwidth correction block 220 may further apply a collar lag compensation to correct for drill collar lag. As described above, drill collar lag may result as the Earth's magnetic field (or other interference magnetic field) induces an electrical current in the wall of the rotating drill collar. This electrical current in turn induces a magnetic field in the drill collar bore (e.g., at the location of the magnetometers). The net effect tends to cause the measured magnetic field to lag behind (i.e., to be phase delayed with respect to) the Earth's true magnetic field. Drill collar lag may be modelled (or approximated) as a low pass filter (in a manner similar to that described above for the signal conditioning circuits 140 and 150) having a time constant $\tau_1$. Therefore, in certain embodiments, the magnetometer measurements may be compensated for attenuation and delay introduced by both collar lag and conditioning circuit 150.

Figure 8:
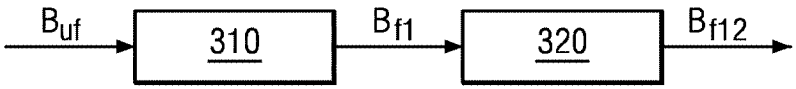
FIG. 8 depicts a block diagram of first and second cascading low pass filters.

FIG. 8 depicts a block diagram of one example embodiment in which the attenuation and delay introduced by collar lag and conditioning circuit 150 are modelled as first and second cascading low pass filters 310 and 320. In FIG. 8, the unfiltered magnetometer input $B_{uf}$, (representing Earth's true magnetic field) is attenuated and delayed by a first low pass filter 310 that models the effect of collar lag. The output from the first low pass filter 310 $B_{f1}$ is then input into a second low pass filter 320 (that models the magnetometer conditioning circuit 150) where it is further attenuated and delayed. The output from the second low pass filter 320 $B_{f12}$ (which has been attenuated and delayed by both low pass filters) is then input into the ADC.

With continued reference to FIG. 8 and reference again to FIG. 5, bandwidth correction block 220 may compensate for both collar lag and conditioning circuit 150. Compensation takes place from right to left in FIG. 8. In other words, the digitized magnetometer measurements are first compensated for the delay induced by the conditioning circuit 150 (the second low pass filter 320) and then the resultant, partially compensated quantity is further compensated for the delay induced by collar lag (the first low pass filter 310). For example, the digitized magnetometer measurements may be compensated according to Equations 5 and 6.

$$B_{c2} = B_{uc} + B_{\perp}\cos\psi(\tau_2^2\psi^2 \quad 3\tau_2^3\psi\psi + 3\tau_2^3\psi^2 \quad \tau_2^4\psi^4) + B_{\perp}\sin\psi(\tau_2\psi + \tau_2^2\psi + \tau_2^3\psi^3 \quad 6\tau_2^4\psi^2\psi) \tag{5}$$

$$B_{c12} = B_{c2} + B_{\perp}\cos\psi(\tau_1^2\psi^2 \quad 3\tau_1^3\psi\psi + 3\tau_1^3\psi^2 \quad \tau_1^4\psi^4) + B_{\perp}\sin\psi(\tau_1\psi + \tau_1^2\psi + \tau_1^3\psi^3 \quad 6\tau_1^4\psi^2\psi) \tag{6}$$

where $B_{uc}$ represents the uncompensated (digitized) magnetometer measurements, $B_{c2}$ represents a partial compensation in which the measurements are compensated for the delay induced by conditioning circuit 150 (and is analogous to $B_{f1}$ in FIG. 8), and $B_{c12}$ represents a full compensation in which the measurements are compensated for delay induced by both collar lag and the conditioning circuit 150 (and is analogous to $B_{uf}$ in FIG. 8), $\tau_1$ represents the time constant of the first low pass filter 310 (the collar lag), and $\tau_2$ represents the time constant of the second low pass filter 320 (conditioning circuit 150). The parameters $\psi$, $\psi$, and $\psi$ are as defined previously.

As described above with respect to Equations 3 and 4, correction block 220 may further correct for the temperature variation in time constants $\tau_1$ and $\tau_2$. For example, $\tau_1$ and $\tau_2$ may be expressed as functions of the measured downhole temperature T such that $\tau_1=f_1$(T) and $\tau_2=f_2$ (T). As described above, $f_2$ may be a polynomial function obtained by empirically fitting temperature dependent time constant data (e.g., over a temperature range from 25 to 175 degrees C.). It has been found that drill collar lag tends to vary linearly with temperature (in the above recited range of temperatures), such that $f_1$ may sometimes be approximated as a linear function (a first order polynomial). Block 220 may be configured to process the downhole temperature measurements T to compute corresponding values of $\tau_1$ and $\tau_2$ according to $f_1$ and $f_2$ (or to obtain the values from corresponding lookup tables). These temperature dependent values of $\tau_1$ and $\tau_2$ may then be used in Equations 5 and 6 to compute the fully compensated magnetic field measurement $B_{c12}$ (i.e., the fully compensated magnetometer measurements).

Turning again to FIG. 5, the compensated accelerometer and magnetometer measurements may be further processed by radial interference compensation block 240 to remove distortion or interference in the transverse components of the magnetometer measurements (e.g., $B_x$, and $B_y$). In the absence of such distortion and/or interference, $B_x$ and $B_y$ trace out a circle in an x-y plot as the drill string rotates in the wellbore (e.g., while drilling). Such a circle is centered at the origin and has a radius equal to $B_{\perp}$. Local disturbances or magnetic interference can create a non-uniform magnetic field such that the locus of $B_x$ and $B_y$ is not centered at the origin and/or traces out an ellipse (rather than a circle). Such disturbances or magnetic interference may be caused, for example, by electrical current flowing through a power bus in the vicinity of the magnetometers. Moreover, a mismatch in the calibrated gains and offsets of the x- and y-axis magnetometers may also result in locus of $B_x$ and $B_y$ tracing an off-centered ellipse.

Block 240 is configured to correct $B_x$ and $B_y$ for such distortion and/or interference. The distorted locus of measurements may be expressed as an ellipse, for example, as follows:

$$\left(\frac{B_x \quad 0_x}{At_x}\right)^2 + \left(\frac{B_y \quad 0_y}{At_y}\right)^2 = 1 \tag{7}$$

where $O_x$ and $O_y$ represent the offsets along the x- and y-axes and $At_x$ and $At_y$ represent the attenuations along the x- and y-axes. In some embodiments, magnetometer measurements $B_x$ and $B_y$ may be collected and binned into a predefined number of azimuthal sectors at 242 while rotating (drilling). For example, the magnetometer measurements may be binned into 36 azimuthal sectors (each of which extends 10 degrees). Upon acquiring an acceptable number of measurements (e.g., when a buffer having a predetermined size is full or when a predetermined number of measurements are received in each azimuthal sector), the binned measurements, including N $B_x$ and $B_y$ measurements, are received by a fitting algorithm at 244. Assuming N pairs of $B_x$ and $B_y$ measurements, the following vector description of the measurements may be generated $$f(p) = \begin{matrix} 1 & \left(\frac{B_{x1} \quad O_x}{At_x}\right)^2 + \left(\frac{B_{y1} \quad O_y}{At_y}\right)^2 \\ 1 & \left(\frac{B_{x2} \quad O_x}{At_x}\right)^2 + \left(\frac{B_{y2} \quad O_y}{At_y}\right)^2 \\ 1 & \left(\frac{B_{xN} \quad O_x}{At_x}\right)^2 + \left(\frac{B_{yN} \quad O_y}{At_y}\right)^2 \end{matrix} \tag{8}$$

where $B_{x1}, B_{x2}, \ldots, B_{xN}$ and $B_{y1}, B_{y2}, \ldots, B_{yN}$ represent the N pairs of $B_x$ and $B_y$ measurements and p represents a vector of offset and attenuations values as follows:

$$p = \begin{matrix} O_x \\ At_x \\ O_y \\ At_y \end{matrix}$$

A best fitting vector p may be computed iteratively for each pair of $B_x$ and $B_y$ measurements in Equation 8, for example, by starting with an estimated p and generating a Taylor series expansion around the estimate. The vector p approaches a best fit when the higher order terms in the Taylor series approach zero (i.e., are less than a threshold). Once solved, the best fitting vector p may be used to compute the corrected (undistorted) measurements from the distorted measurements in circling algorithm 246, for example, as follows:

$$B_{cx} = \frac{B_x \quad O_x}{G_x} \tag{9}$$

$$B_{cy} = \frac{B_y \quad O_y}{G_y} \tag{10}$$

where $B_{cx}$ and $B_{cy}$ represent the corrected (undistorted) x- and y-axis magnetometer measurements, $B_x$ and $B_y$ represent the compensated magnetometer measurements received from block 220 or alternatively the digitized magnetometer measurements from the ADC, and $G_x$ and $G_y$ represent gains that are related to the attenuations $At_x$ and $At_y$, for example, as follows:

$$At_x = (1+\Delta G)B_\perp = G_x B_\perp$$

$$At_y = (1+\Delta G)B_\perp = G_y B_\perp$$

where $\Delta G$ is given as follows:

$$\Delta G = \frac{At_y \quad At_x}{At_y + At_x}$$

With continued reference to FIG. 5, the rotational position, velocity, and acceleration of the drill collar may be computed at block 260 using substantially any suitable methodology. The compensated magnetometer measurements computed in block 220 may be processed to compute the rotational position, e.g., as follows: $\psi = \arctan(B_x/B_y)$. The rotational velocity may then be computed, for example, via differentiating sequential magnetic toolface measurements as follows: $\psi = [\psi(n) \ \psi(n\ 1)]/\Delta t$, where $\psi(n)$ and $\psi(n\ 1)$ represent the sequential rotational position measurements and $\Delta t$ represents the time between sequential measurements (e.g., 5 or 10 milliseconds). The rotational acceleration may then be computed, for example, via differentiating sequential rotational velocity measurements as follows: $\psi = [\psi(n) \ \psi(n\ 1)]/\Delta t$, where $\psi(n)$ and $\psi(n\ 1)$ represent the sequential magnetic toolface measurements.

The rotational position, velocity, and acceleration of the drill collar may alternatively (or additionally) be computed using a finite impulse response (FIR) filter. For example, in one such embodiment, a set of compensated magnetometer measurements may be evaluated using an FIR filter, for example, as follows:

$$x = (H^T H)^{-1} H^T \psi \tag{11}$$

where x represents the unknown vector including the rotational position, velocity, and acceleration of the drill collar, $\psi$ represents rotational position measurements obtained from a set of K compensated magnetometer measurements, and H represents a fully determined transfer matrix, such that:

$$x = \begin{Bmatrix} \psi \\ \psi \\ \psi \end{Bmatrix}$$

$$\psi = \begin{Bmatrix} \psi_0 \\ \psi_1 \\ \\ \psi_K \end{Bmatrix}$$

$$H = \begin{Bmatrix} 1 & 0 & & 0 \\ 1 & t & & t \\ & & & \\ 1 & K\ t & K^2 & t^2 \end{Bmatrix}$$

The right-hand side of Equation 11 represents an FIR filter structure with $(H^T H)^{-1} H^T$ being a 3×K matrix and $\psi$ a moving window of K×1 observations. Thus, for each new value of $\psi$ available, a new (or updated) value for the position, velocity, and acceleration of the drill collar may be computed. As depicted in FIG. 5, the output from block 260 (e.g., the vector x in Equation 11) may be provided to blocks 220 and 240.

With further reference to FIG. 5, various survey parameters may be computed at block 280 from the compensated accelerometer and magnetometer measurements received from blocks 220 and 240. The computed survey parameters may include, for example, wellbore inclination, wellbore azimuth, gravity toolface, magnetic toolface, and dip. The wellbore inclination Inc may be computed from the compensated accelerometer measurements, for example, as follows:

$$Inc = \arctan\left(\frac{A_{c\perp}}{A_{cz}}\right) \tag{12}$$

where $A_{c\perp}$ represents the compensated transverse component of the gravity field received from block 220 and $A_{cz}$ represents the compensated axial component of the gravity field. In some embodiments, $A_{c\perp}$ and $A_{cz}$ may be averaged over several tool rotations while drilling.

The wellbore azimuth Azi may be computed from the compensated accelerometer and magnetometer measurements, for example, as follows:

$$Azi = \arctan\left[\frac{\sin\alpha \cdot \sin\gamma}{\cos\gamma \cdot \sin(Inc) \quad \sin\gamma \cdot \cos\alpha \cdot \cos(Inc)}\right] \tag{13}$$

where α represents the toolface offset (the angular offset between the magnetic and gravity toolface), γ represents the angle between the longitudinal axis of the drill string (the z-axis) and the compensated magnetic field vector, and Inc represents the wellbore inclination, for example, computed according to Equation 12.

The dip angle may also be computed from the compensated accelerometer and magnetometer measurements, for example, as follows:

$$\text{Dip} = \arctan\frac{\cos(Inc) \cdot \cos\gamma + \sin(Inc) \cdot \sin\gamma \cdot \cos\alpha}{\sqrt{(\sin\gamma \cdot \sin\alpha)^2 + (\cos\gamma \cdot \sin(Inc) \quad \sin\gamma\cos\alpha \cdot \cos(Inc))^2}} \tag{14}$$

where α, γ, and Inc are as defined above. The angles α and γ may be computed from the compensated accelerometer and magnetometer measurements, for example, as follows:

$$\gamma = \arctan\left(\frac{B_{c\perp}}{B_{cz}}\right)$$

where $B_{c\perp}$ represents the compensated transverse component of the magnetic field (e.g., received from block 240), $B_{cz}$ represents the compensated axial component of the magnetic field, and $$\alpha = \arctan\left(\frac{A_{c\perp}\sin\alpha}{A_{c\perp}\cos\alpha}\right)$$

where:

$$A_{c\perp} \sin \alpha = A_{cx} \cos \psi_m + A_{cy} \sin \psi_m$$

$$A_{c\perp} \cos \alpha = A_{cy} \cos \psi_m \; A_{cx} \sin \psi_m$$

where $A_{cx}$ and $A_{cy}$ represent the x- and y-axis compensated accelerometer measurements.

The magnetic and gravity toolface angles (MTF and GTF) may also be computed, for example, as follows:

$$MTF = \arctan\left(\frac{B_{cx}}{B_{cy}}\right) + \beta$$

$$GTF = \arctan\left(\frac{A_{cx}}{A_{cy}}\right) = M + \alpha$$

where $B_{cx}$ and $B_{cy}$ represent the x- and y-axis compensated magnetometer measurements and where the angle β may be determined, for example, as follows:

$$\beta = \arctan\left(\frac{K\sin\beta}{K\cos\beta}\right)$$

$$K \sin \beta = \sin(\text{Dip}) \cdot \sin(Inc) \cdot \sin(\alpha)$$

$$K \cos \beta = \sin \gamma \sin(\text{Dip}) \cdot \sin(Inc) \cdot \cos(\alpha)$$

Drill string shock and vibration may be a potential source of error during drilling mode survey operations. Shock and vibration can be particularly problematic during vertical or near-vertical drilling operations. The above described embodiments may optionally further include an additional vibration compensation module, for example, including a Kalman filter and/or an averaging routine to compensate for such shock and vibration.

Figure 9:
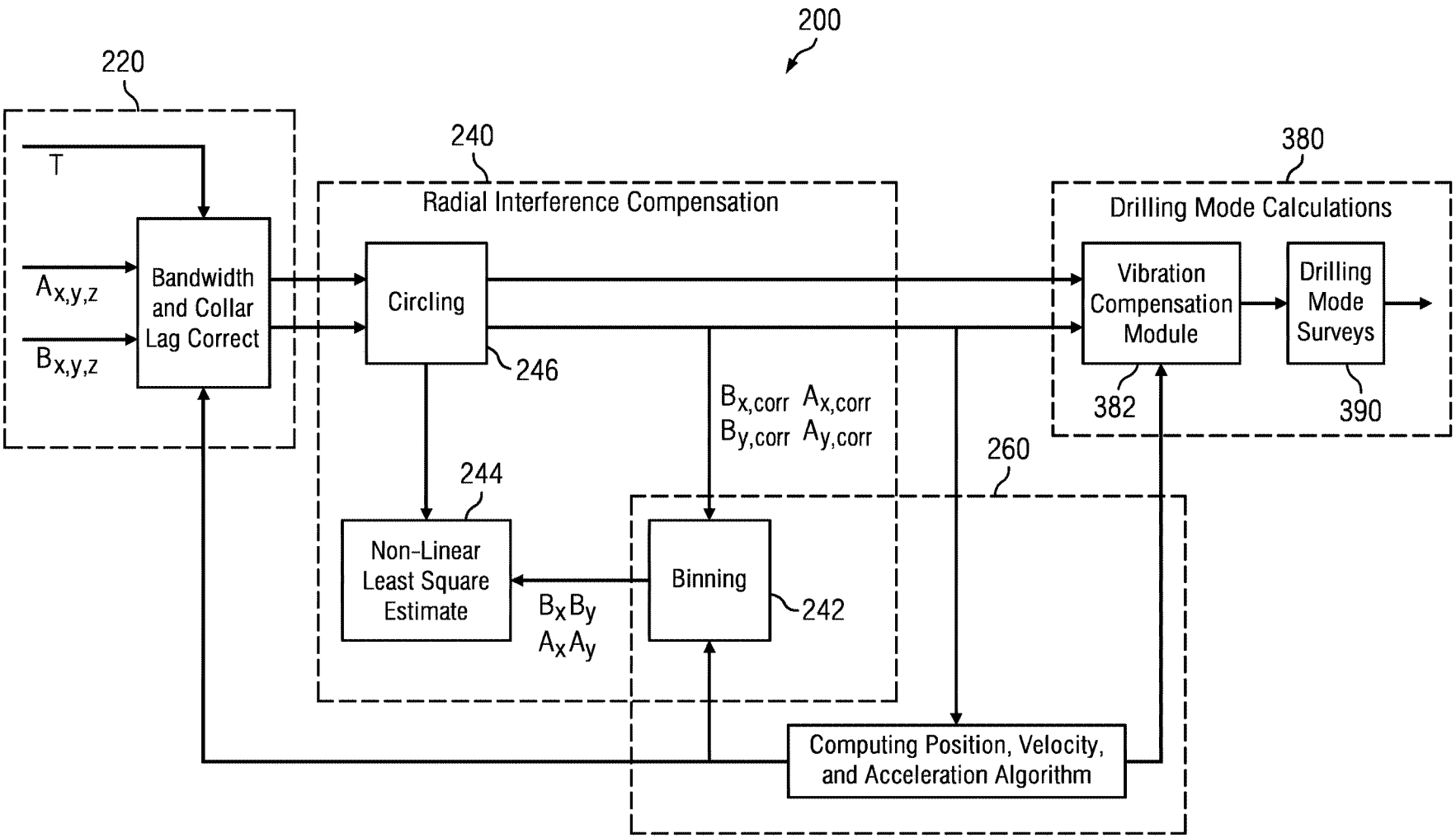
FIG. 9 depicts a block diagram of an alternative example method embodiment for computing survey parameters, such as wellbore inclination, wellbore azimuth, and dip, while drilling a subterranean wellbore.

FIG. 9 depicts a block diagram of an alternative example method 350 for computing survey parameters in real time while drilling a subterranean wellbore. Method 350 is largely identical to method 200 (FIG. 5) in that it includes (i) a bandwidth compensation block 220, (ii) a radial interference compensation block 240, (iii) a dynamics block 260 in which the position, velocity, and acceleration of the drill collar are computed. Method 350 further includes a drilling mode survey block 380 at which the survey parameters are computed. Method 350 differs from method 200 in that the drilling mode survey block 380 includes an optional vibration compensation module 382 configured to compensate for drilling mode noise (e.g., caused by drill string shock and vibration) and a drilling mode survey module 390 in which the survey parameters are computed. The survey module 390 is similar to survey block 280 depicted on FIG. 5 in that it is configured to compute various survey parameters from the compensated and filtered accelerometer and magnetometer measurements received module 382.

Figure 10:
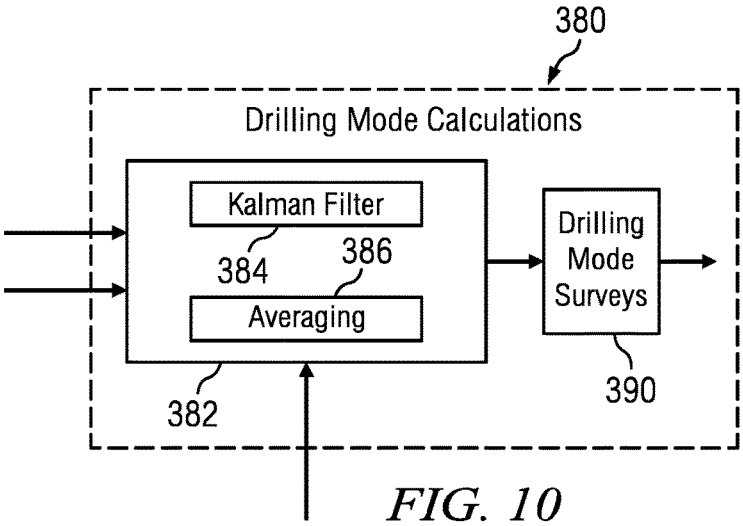
FIG. 10 depicts one example of the drilling mode survey module depicted on on FIG. 9 including a Kalman filter module and an averaging module.

Turning now to FIG. 10, one example of drilling mode survey block 380 is shown in more detail. In the depicted embodiment, the compensation module 382 includes a Kalman filter module 384 and an averaging module 386. Modules 384 and 386 receive input parameters from radial interference compensation block 240 and dynamics block 260 as indicated in FIG. 9. The filtered and averaged output from modules 384 and 386 is received by the survey module 390 as also depicted. While the FIG. 10 embodiment may depict the use of parallel Kalman filter and averaging modules 384 and 386, it will be appreciated that the invention is not limited in these regards. For example, in one alternative embodiment the compensation module 382 may include only a Kalman filtering module 384. In another alternative embodiment, the compensation module 382 may include only an averaging module 386. Example Kalman filtering modules 384 and averaging modules 386 are described in more detail below.

Figure 11:
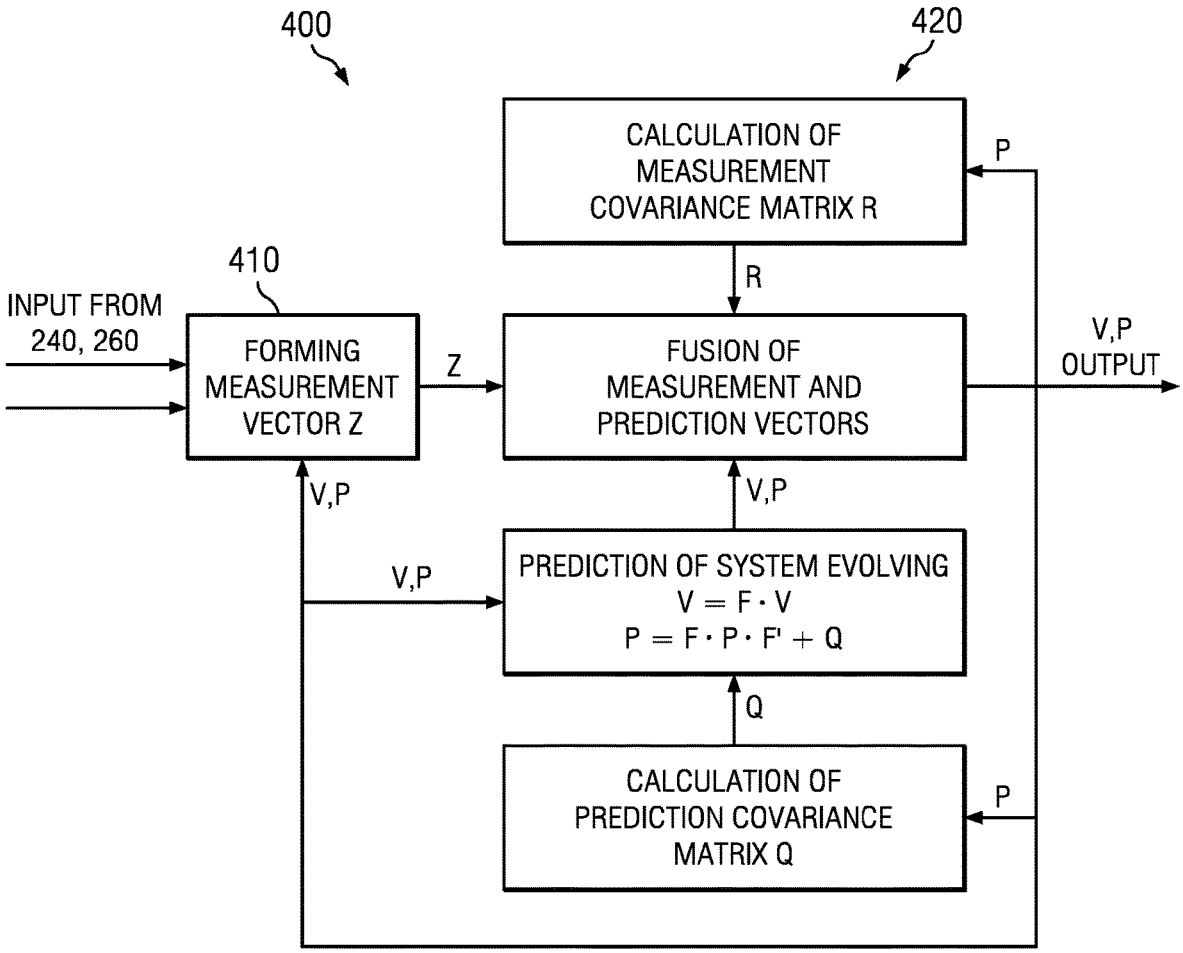
FIG. 11 depicts a block diagram of one example implementation of a Kalman filter.

FIG. 11 depicts one example implementation of the Kalman filter at 400. A Kalman filter (such as module 384 in FIG. 10) may be used to estimate the state of the system (the state of the drilling system) based on a sequence of noisy observations (e.g., the noisy magnetic field and gravity measurements made in a vibrating drill string). As depicted, a measurement vector Z may be formed at 410 from the synchronized accelerometer and magnetometer measurements (e.g., received from blocks 240 and 260 in FIG. 9).

It will be understood that the Kalman filter module 400 assumes that the current state of the system (at time i) emerges from the previous state of the system (at time i 1). This forecasting stage is depicted generally at 420 and may be described, for example, by the following mathematical equations:

$$V_{i-1}^{i}=F_i V_{i-1}^{i-1}+B_i U_i \tag{15}$$

where $V_{i-1}^{i}$ represents the forecast of the current vector state (the current state of the system) based on the final previous vector state $V_{i-1}^{i-1}$ (the previous state of the system), for example, as follows:

$$V_i = \begin{matrix} A_{z_i} \\ A_{z_{i-1}} \; A_{z_{i-2}} \\ A_{x_i}\cos\theta_i \quad A_{y_i}\sin\theta_i \\ \left(A_{x_{i-1}}\cos\theta_{i-1} \quad A_{y_{i-1}}\sin\theta_{i-1}\right) \; \left(A_{x_{i-2}}\cos\theta_{i-2} \quad A_{y_{i-2}}\sin\theta_{i-2}\right) \\ A_{x_i}\sin\theta_i + A_{y_i}\cos\theta_i \\ \left(A_{x_{i-1}}\sin\theta_{i-1} + A_{y_{i-1}}\cos\theta_{i-1}\right) \; \left(A_{x_{i-2}}\sin\theta_{i-2} + A_{y_{i-2}}\cos\theta_{i-2}\right) \\ B_{z_i} \\ B_{z_{i-1}} \quad B_{z_{i-2}} \\ \sqrt{B_{x_i}^2 + B_{y_i}^2} \\ \sqrt{B_{x_{i-1}}^2 + B_{y_{i-1}}^2} \quad \sqrt{B_{x_{i-2}}^2 + B_{y_{i-2}}^2} \end{matrix}$$

and where $B_i$ represents the matrix of steering, which without any knowledge of depth may be assumed to be $B_i=0$, $U_i$ represents the steering vector effecting the system and $F_i$ represents the matrix of vector evolution. Assuming $B_i=0$, the matrix of vector evolution may be given, for example, as follows:

$$F_i = \begin{matrix} 1 & 1 & 0 & 0 & 0 & 0 & 0 & 0 & 0 & 0 \\ 0 & 1 & 0 & 0 & 0 & 0 & 0 & 0 & 0 & 0 \\ 0 & 0 & 1 & 1 & 0 & 0 & 0 & 0 & 0 & 0 \\ 0 & 0 & 0 & 1 & 0 & 0 & 0 & 0 & 0 & 0 \\ 0 & 0 & 0 & 0 & 1 & 1 & 0 & 0 & 0 & 0 \\ 0 & 0 & 0 & 0 & 0 & 1 & 0 & 0 & 0 & 0 \\ 0 & 0 & 0 & 0 & 0 & 0 & 1 & 1 & 0 & 0 \\ 0 & 0 & 0 & 0 & 0 & 0 & 0 & 1 & 0 & 0 \\ 0 & 0 & 0 & 0 & 0 & 0 & 0 & 0 & 1 & 1 \\ 0 & 0 & 0 & 0 & 0 & 0 & 0 & 0 & 0 & 1 \end{matrix}$$

An intermediate filtering covariance matrix $P_{i-1}^{i}$ may be expressed mathematically, for example, as follows:

$$P_{i-1}^{i}=F_i P_{i-1}^{i-1} F_i^T+Q_{i-1} \tag{16}$$

where $Q_{i-1}$ is a covariance matrix of prediction that may be defined, for example, by an expected rate of penetration (ROP), trajectory dog leg severity (DLS), wellbore inclination, and wellbore azimuth and may be expressed mathematically, for example, as follows:

$$Q_{i+1} = \begin{matrix} P_{i_{2,2}}^{i} & 0 & 0 & 0 & 0 & 0 & 0 & 0 & 0 & 0 \\ 0 & (G\gamma)^2 & 0 & 0 & 0 & 0 & 0 & 0 & 0 & 0 \\ 0 & 0 & P_{i_{4,4}}^{i} & 0 & 0 & 0 & 0 & 0 & 0 & 0 \\ 0 & 0 & 0 & (G\gamma)^2 & 0 & 0 & 0 & 0 & 0 & 0 \\ 0 & 0 & 0 & 0 & P_{i_{6,6}}^{i} & 0 & 0 & 0 & 0 & 0 \\ 0 & 0 & 0 & 0 & 0 & (G\gamma)^2 & 0 & 0 & 0 & 0 \\ 0 & 0 & 0 & 0 & 0 & 0 & P_{i_{8,8}}^{i} & 0 & 0 & 0 \\ 0 & 0 & 0 & 0 & 0 & 0 & 0 & (B\gamma)^2 & 0 & 0 \\ 0 & 0 & 0 & 0 & 0 & 0 & 0 & 0 & P_{i_{10,10}}^{i} & 0 \\ 0 & 0 & 0 & 0 & 0 & 0 & 0 & 0 & 0 & (B\gamma)^2 \end{matrix}$$

where G and B represent moduli of the Earth's gravity and magnetic fields, and $\gamma$ represents the expected variation of angle velocity. The expected variation of angle velocity may be defined, for example, as follows:

$$\gamma = k\frac{\pi}{180}\frac{DLS}{30}\frac{ROP}{3600}t$$

where t represents a time period that depends on the sampling frequency such that $t=1/F_s$.

The deviation vector may be expressed mathematically, for example, as follows:

$$Y_i=Z_i H_i V_{i-1}^{i} \tag{17}$$

where $H_i$ is the identity matrix and $Z_i$ is the vector of the measurements, for example, as follows:

$$Z_i = \begin{matrix} A_{z_i} \\ V_{i-1_{1,1}}^{i-1} \; V_{i-2_{1,1}}^{i-2} \\ A_{x_i}\cos\theta_i \quad A_{y_i}\sin\theta_i \\ V_{i-1_{3,1}}^{i-1} \; V_{i-2_{3,1}}^{i-2} \\ A_{x_i}\sin\theta_i + A_{y_i}\cos\theta_i \\ V_{i-1_{5,1}}^{i-1} \; V_{i-2_{5,1}}^{i-2} \\ B_{z_i} \\ V_{i-1_{7,1}}^{i-1} \; V_{i-2_{7,1}}^{i-2} \\ \sqrt{B_{x_i}^2 + B_{y_i}^2} \\ V_{i-1_{9,1}}^{i-1} \; V_{i-2_{9,1}}^{i-2} \end{matrix}$$

A covariance matrix of the deviation vector $Y_i$ may be expressed mathematically, for example, as follows:

$$S_i=H_i P_{i-1}^{i} H_i^T+R_i=P_{i-1}^{i}+R_i \tag{18}$$

where $R_i$ is the covariance matrix of the measurement defined by the drilling (accelerometer) noise $\sigma_A$, the magnetic (magnetometer) noise $\sigma_B$, and the filter covariance matrix P, for example, as follows:

$$R_{i+1} = \begin{matrix} \sigma_G^2 & 0 & 0 & 0 & 0 & 0 & 0 & 0 & 0 & 0 \\ 0 & P^i_{i_{1,1}} & 0 & 0 & 0 & 0 & 0 & 0 & 0 & 0 \\ 0 & 0 & \sigma_G^2 & 0 & 0 & 0 & 0 & 0 & 0 & 0 \\ 0 & 0 & 0 & P^i_{i_{3,3}} & 0 & 0 & 0 & 0 & 0 & 0 \\ 0 & 0 & 0 & 0 & \sigma_G^2 & 0 & 0 & 0 & 0 & 0 \\ 0 & 0 & 0 & 0 & 0 & P^i_{i_{5,5}} & 0 & 0 & 0 & 0 \\ 0 & 0 & 0 & 0 & 0 & 0 & \sigma_B^2 & 0 & 0 & 0 \\ 0 & 0 & 0 & 0 & 0 & 0 & 0 & P^i_{i_{7,7}} & 0 & 0 \\ 0 & 0 & 0 & 0 & 0 & 0 & 0 & 0 & \sigma_B^2 & 0 \\ 0 & 0 & 0 & 0 & 0 & 0 & 0 & 0 & 0 & P^i_{i_{9,9}} \end{matrix}$$

Kalman's matrix of optimal coefficients may be written, for example, as follows:

$$K_i = P_{i-1}{}^i H_i^T S_i^{-1} = P_{i-1}{}^i S_i^{-1} \tag{19}$$

The predicted vector $V_{i-1}{}^i$ may be corrected, for example, as follows:

$$V_i{}^i = V_{i-1}{}^i + K_i Y_i \tag{20}$$

And the final covariance matrix for the ith iteration may be expressed mathematically, for example, as follows:

$$P_i{}^i = (I\ K_i H_i) P_{i-1}{}^i = (I\ K_i) P_{i-1}{}^i \tag{21}$$

With reference again to FIGS. 9-10, averaging module 386 may be further implemented to compensate for the influence of drill string shock and vibration. For example, the corrected accelerometer and magnetometer inputs received from radial interference compensation block 240 may be averaged as follows:

$$A_z = \frac{1}{N}\sum_{i=1}^{N} A_{z_i}$$

$$At\sin(\alpha) = \frac{1}{N}\sum_{i=1}^{N} (\ G_{x_i}\cos\theta_i \quad G_{y_i}\sin\theta_i\ )$$

$$At\cos(\alpha) = \frac{1}{N}\sum_{i=1}^{N} (G_{x_i}\sin\theta_i + G_{y_i}\cos\theta_i)$$

$$B_z = \frac{1}{N}\sum_{i=1}^{N} B_{z_i}$$

$$B_t = \frac{1}{N}\sum_{i=1}^{N} \sqrt{B_{x_i}^2 + B_{y_i}^2}$$

where N represents the number of averaged samples in sample period $T_0$ such that $N=F_s\ T_0$. Axial and lateral root mean square (RMS) shock may be computed, for example, as follows:

$$\sigma_z = \left( \frac{1}{M}\sum_{i=1}^{M} (A_{z_i})^2 \quad A_A^2 + SF^2 \right)^{1/2}$$

$$\sigma_{xy} = \left( \frac{1}{M}\sum_{i=1}^{M} ((A_{x_i})^2 + (A_{y_i})^2) \quad A_H^2 \quad A_L^2 + SF^2 \right)^{1/2}$$

where M represents the number of samples per cycle such that $M=F_s\ T_c$ and SF represents a safety factor, such as SF=0.1 G, damping statistical fluctuations. It will be understood that further corrections may be implemented to adjust for any time delays (e.g., if the time period is known at the surface).

The computed survey parameters may be stored in downhole memory and transmitted to the surface, for example, via mud pulse telemetry, electromagnetic telemetry (or other telemetry techniques). In some embodiments, the accuracy of the computed parameters may be sufficient such that the drilling operation may forego the use of conventional static surveying techniques. In such embodiments, the wellbore survey may be constructed at the surface based upon the transmitted measurements.

With reference again to FIG. 3, the survey parameters measured at 108 (and in block 280 of FIG. 5) may be used to control and/or change the direction of drilling in 110. For example, in many drilling operations the wellbore (or a portion of the wellbore) is drilled along a drill plan, such as a predetermined direction (e.g., as defined by the wellbore inclination and the wellbore azimuth) or a predetermined curvature. In some embodiments, the computed wellbore inclination and wellbore azimuth may be compared with a desired inclination and azimuth. The drilling direction may be changed, for example, in order to meet the drill plan, or when the difference between the computed and desired direction or curvature exceeds a predetermined threshold. Such a change in drilling direction may be implemented, for example, via actuating steering elements in a rotary steerable tool deployed above the bit. In some embodiments, the survey parameters may be sent directly to an RSS, which processes the survey parameters compared to the drill plan, (e.g., predetermined direction or predetermined curve) and changes drilling direction in order to meet the plan. In some embodiments the survey parameters may be sent to the surface using telemetry so that the survey parameters may be analysed. In view of the survey parameters, drilling parameters (e.g., weight on bit, rotation rate, mud pump rate, etc.) may be modified and/or a downlink may be sent to the RSS to change the drilling direction. In some embodiments both downhole and surface control may be used.

It will be appreciated that the methods described herein may be configured for implementation via one or more controllers deployed downhole (e.g., in a rotary steerable tool or in an MWD tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 3, 5, and 9-11. A suitable controller may also optionally include other controllable components, such as sensors (e.g., a temperature sensor), data storage devices, power supplies, timers, and the like. The controller may also be disposed to be in electronic communication with the accelerometers and magnetometers, for example, as depicted on FIG. 4. A suitable controller may also optionally communicate with other instruments in the drill string, such as, for example, telemetry systems that communicate with the surface. A suitable controller may further optionally include volatile or non-volatile memory or a data storage device.

Although a surveying while drilling method and certain advantages thereof have been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

We claim:

1. A method for drilling a subterranean wellbore, the method comprising:

(a) rotating a drill string in the subterranean wellbore to drill the wellbore, the drill string including a drill collar, a drill bit, and a triaxial accelerometer set and a triaxial magnetometer set deployed in the drill collar;

(b) causing the triaxial accelerometer set and the triaxial magnetometer set to make corresponding triaxial accelerometer measurements and triaxial magnetometer measurements while rotating in (a);

(c) synchronizing the triaxial accelerometer measurements and the triaxial magnetometer measurements made in (b) to obtain synchronized accelerometer and magnetometer measurements; and (d) processing the synchronized accelerometer and magnetometer measurements obtained in (c) to compute at least an inclination and an azimuth of the subterranean wellbore while drilling in (a);

wherein the triaxial accelerometer measurements and the triaxial magnetometer measurements are synchronized in (c) by removing a first time lag from the triaxial magnetometer measurements of (b) and removing a second time lag from the triaxial accelerometer measurements of (b), wherein the first time lag includes a time lag induced by signal processing circuitry that processes the triaxial magnetometer measurements prior to digitizing signals representing the triaxial magnetometer measurements, and the second time lag includes a time lag induced by signal processing circuitry that processes the triaxial accelerometer measurements prior to digitizing signals representing the triaxial accelerometer measurements.

2. The method of claim 1, further comprising:

(e) changing a direction of drilling the subterranean wellbore in response to at least one of the inclination and azimuth computed in (d).

3. The method of claim 2, wherein:

the drill string further comprises a rotary steerable drilling tool deployed uphole from the drill bit; and (e) further comprises actuating a steering element on the rotary steerable tool to change the direction of drilling.

4. The method of claim 1, wherein the first time lag does not equal the second time lag.

5. The method of claim 1, wherein the first time lag further includes an additional time lag induced by rotation of the drill collar.

6. The method of claim 5, wherein the first time lag is removed from the magnetometer measurements by sequentially removing the additional time lag induced by rotation of the drill collar and then removing the time lag induced by the signal processing circuitry that processes the triaxial magnetometer measurements.

7. The method of claim 1, wherein:

(b) further comprises operating a temperature sensor to measure a downhole temperature while rotating in (a); and the downhole temperature is used to remove the first time lag from the triaxial magnetometer measurements of (b) in a manner that corrects for temperature variation in the first time lag, and the downhole temperature is used to remove the second time lag from the triaxial accelerometer measurements of (b) in a manner that corrects for temperature variation in the second time lag.

8. The method of claim 7, wherein:

removing the first time lag from the triaxial magnetometer measurements of (b) and removing the second time lag from the triaxial accelerometer measurements of (b) involves (i) processing the downhole temperature to compute a first time constant and a second time constant, (ii) processing the magnetometer measurements to compute a rotational position, a rotational velocity, and a rotational acceleration of the drill string, (iii) processing the first time constant, and the rotational position, the rotational velocity, and the rotational acceleration of the drill string to remove the first time lag from the triaxial magnetometer measurements, and (iv) processing the second time constant, and the rotational position, the rotational velocity, and the rotational acceleration of the drill string to remove the second time lag from the triaxial accelerometer measurements.

9. The method of claim 7, wherein:

removing the first time lag from the triaxial magnetometer measurements of (b) and removing the second time lag from the triaxial accelerometer measurements of (b) involves (i) processing the downhole temperature to compute a first time constant, a second time constant, and a third time constant, (ii) processing the magnetometer measurements to compute a rotational position, a rotational velocity, and a rotational acceleration of the drill string, (iii) processing the first time constant, the second time constant, and the rotational position, the rotational velocity, and the rotational acceleration of the drill string to remove the first time lag from the triaxial magnetometer measurements, and (iv) processing the third time constant and the rotational position, the rotational velocity, and the rotational acceleration of the drill string to remove the second time lag from the triaxial accelerometer measurements.

10. The method of claim 9, wherein the first time lag further includes an additional time lag induced by rotation of the drill collar, wherein the first time lag is removed from the magnetometer measurements by sequentially removing the additional time lag induced by rotation of the drill collar and then removing the time lag induced by the signal processing circuitry that processes the triaxial magnetometer measurements.

11. The method of claim 1, wherein the synchronizing in (c) further comprises (i) fitting transverse components of the magnetometer measurements to an ellipse to compute first and second offsets and first and second attenuations thereof and (ii) removing the first and second offsets and the first and second attenuations from the magnetometer measurements.

12. The method of claim 1, wherein (d) further comprises (i) processing the synchronized accelerometer and magnetometer measurements obtained in (c) with a Kalman filter to obtain filtered measurements and (ii) processing the filtered measurements to compute at least the inclination and the azimuth of the subterranean wellbore while drilling in (a).

13. The method of claim 1, wherein (d) further comprises (i) processing the synchronized accelerometer and magnetometer measurements obtained in (c) with a Kalman filter to obtain filtered measurements, (ii) processing the synchronized accelerometer and magnetometer measurements obtained in (c) to compute average measurements and (iii) processing the filtered measurements obtained in (i) and the averaged measurements obtained in (ii) to compute at least the inclination and the azimuth of the subterranean wellbore while drilling in (a).

14. A method for drilling a subterranean wellbore, the method comprising:

(a) drilling the subterranean wellbore via rotating a drill string therein, the drill string including a drill bit, a triaxial accelerometer set, and a triaxial magnetometer set;

(b) causing the triaxial accelerometer set and the triaxial magnetometer set to make corresponding analog triaxial accelerometer measurements and analog triaxial magnetometer measurements while drilling in (a);

(c) filtering the triaxial magnetometer measurements made in (b) using a first analog circuit located in the drill string to obtain filtered triaxial magnetometer measurements;

(d) filtering the triaxial accelerometer measurements made in (b) using a second analog circuit located in the drill string to obtain filtered triaxial accelerometer measurements;

(e) digitizing the filtered triaxial magnetometer measurements obtained in (c) and the filtered triaxial accelerometer measurements obtained in (d) to obtain digitized triaxial magnetometer measurements and digitized triaxial accelerometer measurements;

(f) processing the digitized magnetometer measurements to remove a first time lag and thereby obtain compensated magnetometer measurement;

(g) processing the digitized accelerometer measurements to remove a second time lag and thereby obtain compensated accelerometer measurements; and (h) processing the compensated magnetometer measurements and the compensated accelerometer measurements to compute an inclination and an azimuth of the subterranean wellbore while drilling in (a).

15. The method of claim 14, further comprising:

(i) changing a direction of drilling the subterranean wellbore in (a) in response to at least one of the inclination and azimuth computed in (h).

16. The method of claim 14, wherein:

(b) further comprises operating a temperature sensor to measure a downhole temperature while rotating in (a); and the downhole temperature is used in (f) to remove the first time lag from the digitized triaxial magnetometer measurements in a manner that corrects for temperature variation in the first time lag, and the downhole temperature is used in (g) to remove the second time lag from the digitized triaxial accelerometer measurements in a manner that corrects for temperature variation in the second time lag.

17. The method of claim 16, wherein the first time lag includes a time lag induced by the first analog and an additional time lag induced by rotation of a drill collar, wherein the first time lag is removed from the digitized magnetometer measurements by sequentially removing the additional time lag induced by rotation of the drill collar and then removing the time lag induced by the first analog circuit.

18. The method of claim 14, wherein the processing in (h) further comprises (i) fitting transverse components of the magnetometer measurements to an ellipse to compute first and second offsets and first and second attenuations thereof and (ii) removing the first and second offsets and the first and second attenuations from the magnetometer measurements.

19. The method of claim 14, wherein (h) further comprises (i) processing the compensated accelerometer and magnetometer measurements obtained in (f) and (g) with a Kalman filter to obtain filtered measurements and (ii) processing the filtered measurements to compute the inclination and the azimuth of the subterranean wellbore while drilling in (a).

20. The method of claim 14, wherein (h) further comprises (i) processing the compensated accelerometer and magnetometer measurements obtained in (f) and (g) with a Kalman filter to obtain filtered measurements, (ii) processing the compensated ynchronized accelerometer and magnetometer measurements obtained in (f) and (g) to compute average measurements and (iii) processing the filtered measurements obtained in (i) and the averaged measurements obtained in (ii) to compute the inclination and the azimuth of the subterranean wellbore while drilling in (a).

21. The method of claim 14, wherein the first time lag includes a time lag induced by the first analog circuit, and the second time lag includes a time lag induced by the second analog circuit.

22. A system for drilling a subterranean wellbore, the system comprising:

a bottom hole assembly configured to drill the subterranean wellbore via rotating therein on a drill string;

a triaxial magnetometer set and a triaxial accelerometer set deployed in the bottom hole assembly, the triaxial magnetometer set in electrical communication with a first analog circuit and the triaxial accelerometer set in electrical communication with a second analog circuit;

the first analog circuit and the second analog circuit in electrical communication with an analog to digital converter, the analog to digital converter configured to digitize signals received from the first analog circuit and the second analog circuit;

the analog to digital converter in electronic communication with a digital signal processor, the digital signal processor configured to (i) process digitized magnetometer measurements to remove a first time lag induced by the first analog circuit and thereby obtain compensated magnetometer measurements, (ii) process digitized accelerometer measurements to remove a second time lag induced by the second analog circuit and thereby obtain compensated accelerometer measurements, and (iii) process the compensated magnetometer measurements and the compensated accelerometer measurements to compute an inclination and an azimuth of the subterranean wellbore while drilling.

23. The system of claim 22, further comprising a rotary steerable drilling tool deployed in the bottom hole assembly, the rotary steerable drilling tool configured to change a direction of drilling the subterranean wellbore in response to the inclination and azimuth computed by the digital signal processor.

24. The system of claim 22, further comprising:

a temperature sensor deployed in the bottom hole assembly and configured to measure a downhole temperature while drilling, wherein the digital signal processor is further configured to (iv) process the downhole temperature to compute a first time constant of the first analog circuit and a second time constant of the second analog circuit and (v) process the magnetometer measurements to compute a rotational position, a rotational velocity, and a rotational acceleration of the bottom hole assembly in the subterranean wellbore, and wherein the digitized magnetometer measurements are processed in (i) in combination with the first time constant, and the rotational position, the rotational velocity, and the rotational acceleration of the bottom hole assembly to remove the first time lag from the magnetometer measurements.

25. The system of claim 24, wherein the digital signal processor is further configured to process the downhole temperature in (iv) to compute a collar lag, and wherein the digitized magnetometer measurements are processed in (i) to remove the first time lag and the collar lag from the magnetometer measurements.

* * * * *